United States Patent [19]

Mushenko et al.

[11] 4,184,637

[45] Jan. 22, 1980

[54] OXYGEN-FUEL CUTTING TORCH

[76] Inventors: Nikolai Y. Mushenko, ulitsa N. Kurchenko, 15, kv. 48; Gennady P. Larin, ulitsa Sotsialistiches kaya, 57, kv. 5; Vladimir P. Seredenko, ulitsa S. Lazo, 45, kv. 10; Ivan P. Svetikov, ulitsa Marata, 11, kv. 16, all of Kramatorsk, U.S.S.R.

[21] Appl. No.: 957,479

[22] Filed: Nov. 3, 1978

Related U.S. Application Data

[63] Continuation of Ser. No. 772,445, Feb. 28, 1977, Pat. No. 4,136,827.

[51] Int. Cl.[2] ..... B05B 7/06

[52] U.S. Cl. ..... 239/419.3; 239/424

[58] Field of Search ..... 239/419, 419.3, 422, 239/424, 424.5, 427.5

[56] References Cited

U.S. PATENT DOCUMENTS

| | | | |
|---|---|---|---|
| 2,520,001 | 8/1950 | Eicher | 239/419 X |
| 3,389,861 | 6/1968 | Nakanishi et al. | 239/422 |
| 3,455,514 | 7/1969 | Fenley, Jr. | 239/422 X |
| 4,022,383 | 5/1977 | Zeley | 239/419.3 |

*Primary Examiner*—John J. Love

*Attorney, Agent, or Firm*—Lackenbach, Lilling & Siegel

[57] ABSTRACT

The oxygen-fuel cutting torch has a head to one face of which three gas supply conduits communicating with three longitudinal ducts are connected and to the other face of which by means of a nut an outer tip is connected. An inner tip is disposed coaxially with a second duct and the outer tip. The inner tip defines with the wall of said second duct an annular chamber communicating with the second duct and a longitudinal annular metering passageway which communicates with said annular chamber and an annular channel between the tips. Between the faces of the head and the outer tip, there are provided an annular seal and a transverse annular metering passageway communicating with said annular channel between the tips and with a second annular chamber which is connected to the third longitudinal duct in the head. The present oxygen-fuel cutting torch is simpler in construction than known similar cutting torches.

2 Claims, 6 Drawing Figures

OXYGEN-FUEL CUTTING TORCH

This is a continuation of application Ser. No. 772,445, filed Feb. 28, 1977, now U.S. Pat. No. 4,136,827 granted Jan. 30, 1979.

FIELD OF THE INVENTION

The present invention relates to oxygen-fuel cutting torches used for cutting into pieces metal ingots produced on continuous and semi-continuous metal casting installations.

The invention may be applied most advantageously to cutting ingots of a large cross-section area, e.g. at least about 900 mm in thickness.

DESCRIPTION OF THE PRIOR ART

Known is an oxygen-fuel cutting torch having a head with longitudinal ducts to which gas supply conduits are connected. Such a torch is disclosed in USSR Inventor's Certificate No. 165641.

One of the ducts is aligned with the longitudinal axis of the head and communicates with an inner tip coaxial with an outer tip secured to the head by means of a nut. Made in the head are two annular chambers, each of which is connected with a respective longitudinal duct.

These annular chambers are coaxial with each other and have three annular seals located in one plane to prevent gas from escaping from one chamber into the other and to maintain a specified gas pressure within each chamber.

Metering passageways of a small cross-section area are made in the head to allow gas to escape from the annular chambers. Each pair of these metering passageways includes passages disposed in angular relation to each other and communicating with different annular chambers. Extending along the outer tip are outlet ducts, each of which is connected with a pair of said metering passageways.

In operation, oxygen is delivered through the supply conduits into the central duct and one of the longitudinal ducts communicating with an annular chamber. A fuel gas, e.g. natural gas such as propane or acetylene, is supplied through the respective supply conduit into the second longitudinal duct connected to the second annular chamber. The oxygen and the fuel gas pass from the annular chambers through the respective pairs of the metering passageways of a small cross-section area into each duct made in the wall of the outer tip and mix there, thereby producing a fuel gas mixture. The mixture is blown out of each duct in the wall of the outer tip, forming a preheating flame.

Passing from the respective gas supply conduit, cutting oxygen enters the channel of the inner tip and is blown out.

Oxygen-fuel cutting torches of the type described are widely used for cutting metal ingots into pieces and for removing ingot risers.

However, in the process of making such cutting torches, a considerable number of passages need to be drilled both in the head's body and along the wall of the outer tip. Substantial problems stem from the angular arrangement of the metering passageways in relation to each other, the small cross-section area thereof and the strict positional requirements for these passageways to ensure their alignment with the ducts in the wall of the outer tip.

Furthermore, there are substantial difficulties to overcome in making the annular chambers hermetic since it requires reliable construction and assembly of the three seals.

A known oxygen-fuel cutting torch, described in U.S. Pat. No. 3,389,861 has a head with gas supply conduits connected to suitable longitudinal ducts communicating with respective annular chambers and metering passageways for conveying oxygen and fuel gas to the outlet openings made in the wall of the outer tip. In this cutting torch, the upper face portion of the outer tip is shaped to a tapered form and defines, together with the wall of a chamber made in the lower portion of the head, annular chambers separated from each other by means of several annular seals.

Here, the making of metering passages of a small cross-section area presents the aforementioned difficulties. Moreover with the use of three annular seals located on one tapered surface, the protection against explosions and tightness of the annular chambers, where the gases flow under distinct pressures, cannot be easily provided.

Despite a considerable number of metering passageways, known cutting torches do not provide sufficiently homogeneous oxygen-fuel gas mixture in the mixer chambers. Accordingly, no uniform flame along the length and the circumference of the tip is obtained.

Modern metallurgy is characterized by the rapid growth of steel production in installations for continuous and semicontinuous casting.

The need for growing volumes of metal casting and ingots of larger cross-section areas is ever increasing. This primarily calls for the use of high-output and reliable equipment that meets up-to-date technology and security requirements.

Oxygen-fuel gas cutting of metal ingots, which necessitates special gas cutting equipment, is now among the main processes in the production of steel ingots on installations for continuous and semi-continuous casting.

Thus, a need has lately arisen for substantial improvement in known constructions of oxygen-fuel cutting torches.

SUMMARY OF THE INVENTION

The main object of the present invention is to provide an oxygen-fuel cutting torch which is simpler in construction than the known gas cutting torches used for similar purpose.

Another important object of the invention is to improve the operational reliability of an oxygen-fuel cutting torch.

Still another object of the invention is to provide the supply of oxygen and fuel gas in uniformly thick and continuous annular streams which meet in the mixer channel to produce a homogeneous gas mixture.

These and other objects are accomplished by providing an oxygen-fuel cutting torch having a head with gas supply conduits connected thereto. These conduits communicate with suitable ducts longitudinally extending through the head. An inner tip is coaxially disposed with one of said ducts and defines with the wall thereof an annular chamber communicating with a second duct. A third longitudinal duct is in communication with a second annular chamber. These annular chambers communicate with a mixing chamber which serves for obtaining a fuel gas mixture and for letting it escape from an outer tip, which is disposed coaxially with the inner tip and secured to the head by means of a nut. According to the invention, an annular channel between the walls of the outer tip and the inner tip define the mixing chamber for obtaining the fuel gas mixure. One of said annular chambers communicates with said annular channel through a longitudinal annular metering passageway between the wall of the inner tip and the wall of the longitudinal duct coaxial with said inner tip. The second annular chamber communicates with said annular channel through a transverse annular metering passageway between the face of the head and the fact of the outer tip.

In this cutting torch, the mixing chamber and the metering passageways result from turning the proper surfaces of the tips and the head. Here, the amount of duct drilling work is substantially reduced, and the drilling of a considerable number of narrow passages disposed in pairs in an angular relation to each other is completely eliminated since they all, according to the invention, are replaced by two continuous annular metering passageways, whereas all the ducts in the wall of the outer tip are replaced by one annular channel (gap) between the tips.

One annular seal has proved sufficient to tighten the annular chambers, which results in higher operational reliability and security.

Moreover, this cutting torch is not only simple in construction, but also suitable for mounting, removing, inspecting, and handling.

The annular metering passageways provide for the supply of gas in a circumferentially uniform stream, and the fuel gas mixture stream blowing through the annular channel between the tips provides a uniform flame.

It is preferable to furnish the cutting torch with a tubular component so disposed in said longitudinal annular metering passageway that it separates this passageway from the second annular chamber communicating with said transverse annular metering passageway. Here, it is preferable that a cylindrical portion, and a tapered portion whose diameter increases towards the outlet of the fuel gas mixture, be made on the outer tip's internal surface surrounding the annular channel.

Such a construction makes for a reduced cross-section area of the torch head, since the gas streams directed to the mixer channel can be arranged at an angle of less than 90° to each other. The streams are coaxial and are annular in cross section.

The channel made between the tips widening toward the outlet of fuel gas mixture allows the injection rate and the stability of flame to be improved.

The cutting torch can be provided with an annular insert adjoining the internal surface of the outer tip, and said cylindrical and tapered portions can be made on the internal surface of this insert.

The use of the insert considerably facilitates the manufacture of the outer tip.

BRIEF DESCRIPTION OF THE INVENTION

In order that the invention may be more readily understood, its embodiments will now be described with reference to the accompanying drawings in which.

DETAILED DESCRIPTION OF THE INVENTION

Figure 1:
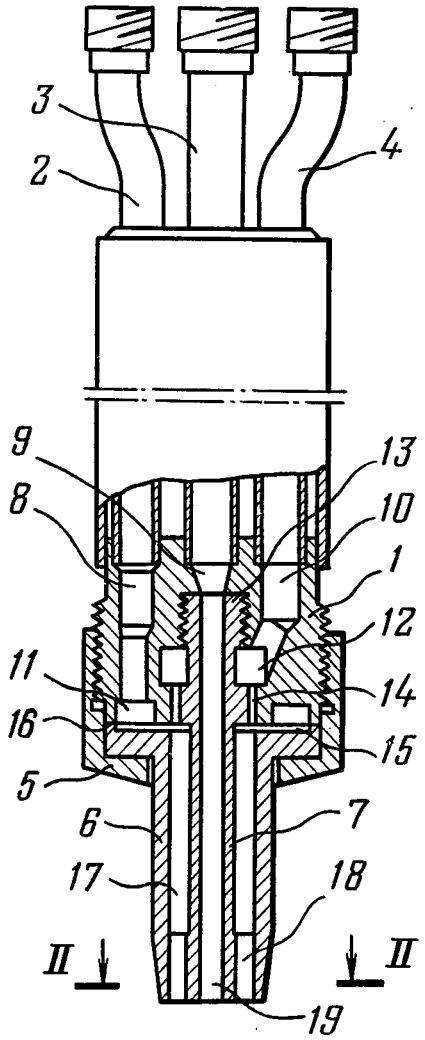
FIG. 1 is a partially sectional, elevational view of the oxygen-fuel cutting torch according to the invention.

The oxygen-fuel cutting torch has a head 1 (FIG. 1), to one face of which gas supply conduits 2, 3, and 4 are connected and to the other face of which an outer tip 6 is connected by means of a nut 5. Inside the outer tip 6, an inner tip 7 is coaxially disposed. The gas supply conduits 2, 3 and 4 are in communication with ducts 8, 9 and 10, respectively. The conduit 2 is connected to the head 1 at the location of the inlet of the duct 8 communicating with an annular chamber 11 for fuel gas. The conduit 4 is connected to the head 1 at the location of the inlet of the duct 10 communicating with the annular chamber 12 for oxygen. The conduit 3, used for the supply of cutting oxygen, is connected to the head 1 at the location of the inlet of the duct 9, which is disposed in this embodiment in line with the longitudinal axis of the head 1. The duct 9 has a larger diameter at its outlet portion and the inner tip 7 is coaxially secured therein by means of a threaded portion 13. Suitable annular recesses forming an annular chamber 12 for oxygen are made on the external surface of the inner tip 7 and the internal surface of the duct 9. In addition, between the external surface of the inner tip 7 and the wall of the duct 9 there is provided a longitudinal annular passageway 14 for metering oxygen, which communicates with the annular chamber 12.

Between the lower face of the head 1 and the upper face of the outer tip 6, there is an annular passageway 15 for metering fuel gas, which is disposed transversely of the longitudinal axis of the head 1.

A seal 16 placed near the nut 5 ensures a tight coupling between the head 1 and the outer tip 6.

Figure 2:
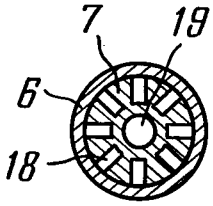
FIG. 2 is a cross-sectional view taken along the line II—II of FIG. 1.

The passageway 15 provides communication between the annular chamber 11 for fuel gas and a channel 17 defined between the outer tip 6 and the inner tip 7. In this channel 17 oxygen and fuel gas mix and the fuel gas mixture obtained is blown through openings 18 (FIG. 2) which are made at the outward end of the inner tip 7 between longitudinally extending spline-like projections. The inner tip 7 has an inner duct 19.

The oxygen-fuel cutting torch according to the invention operates as follows.

To cut a metal ingot (not shown) into pieces or to cut off an ingot riser, the cutting torch is properly oriented and advanced to the selected location of the cut. Fuel gas is supplied by means of the supply conduit 2 (FIG. 1) through the longitudinal duct 8 into the annular chamber 11 and, from there, through the transverse annular passageway 15 into the annular mixing channel 17 between the walls of the tips 6 and 7. Oxygen is supplied through the supply conduit 4 and the longitudinal duct 10 into the annular chamber 12, from which it passes through the longitudinal annular metering passageway 14 into the annular mixing channel 17 and mixes with the fuel gas, the fuel gas mixture being blown out of said mixer channel 17.

After the ingot portion to be cut is heated to the fusing temperature, the cutting oxygen is supplied through the conduit 3 and the duct 9 into the duct 19 of the inner tip 7 wherefrom it blows, cutting the ingot.

One first the cutting is completed, the supply of oxygen through the conduit 3, and then the supply of fuel gas and oxygen through the respective conduits 2 and 4, is stopped. This ends the process of cutting a metal ingot with the oxygen-fuel cutting torch made according to the invention.

Figure 3:
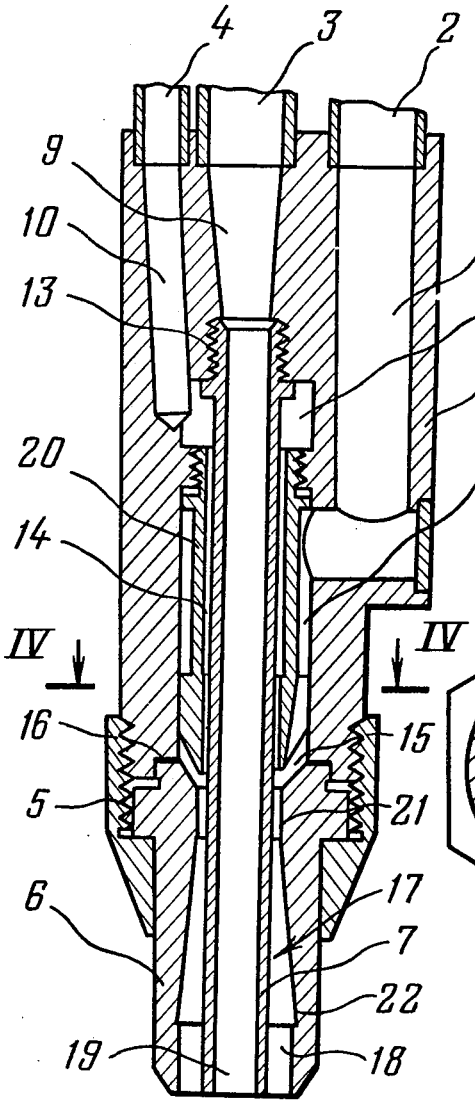
FIG. 3 is a sectional, elevation of the cutting torch, according to the invention, with a tubular component.
Figure 4:
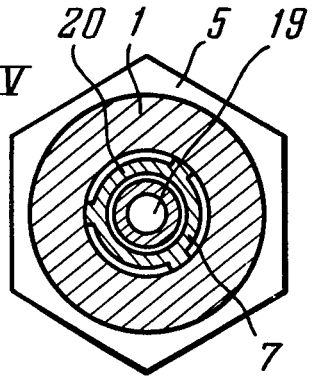
FIG. 4 is a cross-sectional view taken along the line IV—IV of FIG. 3.

In accordance with another embodiment of the cutting torch, it can be provided with a tubular component 20 (FIGS. 3 and 4) placed in the longitudinal annular passageway 14 to separate it from the fuel gas annular chamber 11, which communicates with the longitudinal duct 8 in the head 1 and with a transverse annular metering passageway 15.

In this embodiment, the mixing channel 17 is surrounded with a cylindrical portion 21 and a tapered portion 22 made on the internal surface of the outer tip 6, whose diameter increases toward the outlet of the fuel gas mixture.

Such a construction of the cutting torch is preferable for cutting risers from large steel castings (blanks or finished articles). Here, the inner tip 7 is set off from the longitudinal axis of the head, which allows the remaining portion of the riser to be reduced to a minimum.

Figure 5:
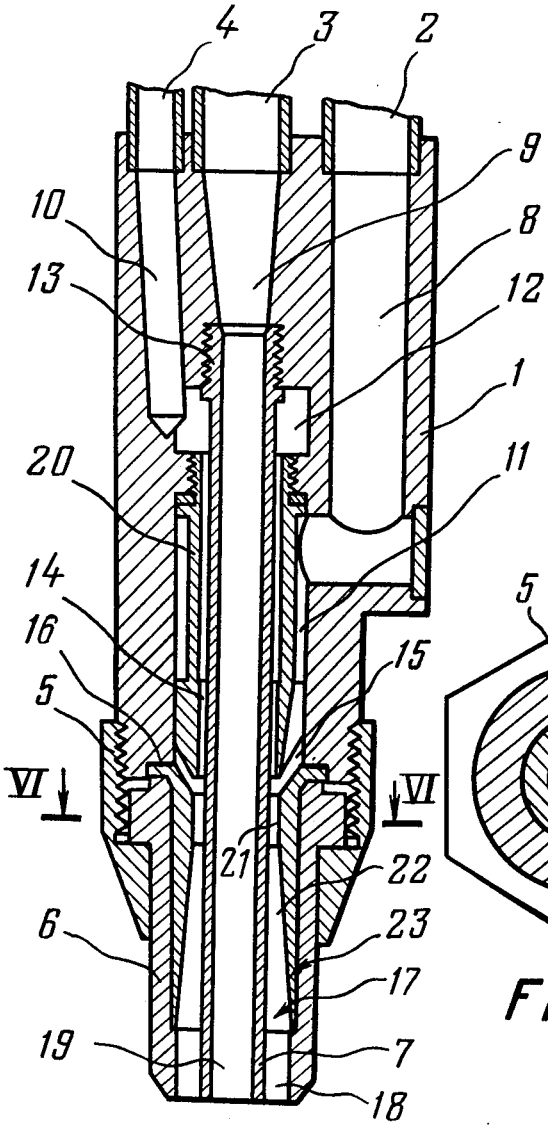
FIG. 5 is a sectional, elevation of the cutting torch, according to the invention, with a tapered insert.
Figure 6:
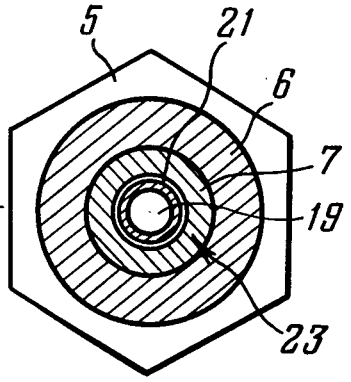
FIG. 6 is a cross-sectional view taken along the line VI—VI of FIG. 5.

The tapered portion (diffuser) of the channel 17 (FIGS. 5 and 6) between the outer tip 6 and the inner tip 7 is easier to make if the cutting torch is provided with an annular insert 23 adjoining the internal surface of the outer tip 6 and having on its internal surface a cylindrical portion 21 and a tapered portion 22, whose diameter increases toward the fuel gas mixture outlet.

The oxygen-fuel cutting torches shown in FIGS. 3 and 4 and 5 and 6 operate substantially similarly to that made in accordance with the first embodiment. Fuel gas is directed from the supply conduit 2 (FIG. 3) to the annular chamber 11 and passes through the transverse annular metering passageway 15 into the mixing channel 17 between the tips 6 and 7.

The preheated oxygen is supplied from the conduit 4 through the longitudinal duct 10 into the annular chamber 12 (FIG. 5) and is then passed through the longitudinal annular metering passageway 14 into the mixing channel 17 between the tips 6 and 7, where it mixes with the fuel gas and the mixture is blown out. The cutting oxygen is supplied through the conduit 3, the longitudinal duct 9, and the duct 19 in the inner tip.

The process of ingot cutting is carried out as is described in the first example.

As experiments have shown, the oxygen-fuel cutting torch according to the present invention offers a high output in cutting metal ingots of a large cross-section area, provides for high operational reliability and is simpler in construction than the known oxygen-fuel cutting torches which are now in use.

The aforesaid cutting torch can also be successfully used for cutting metal materials of a small cross-sectional area.

What is claimed is:

1. An oxygen-fuel cutting torch comprising: a head having three ducts longitudinally extending therethrough, a first of said ducts communicating with a first annular chamber made in said head, a second of said ducts communicating with a second annular chamber, and a third of said ducts being wider as its outlet portion; three gas supply conducts, each being connected to said head and communicating with a respective longitudinal duct; an inner tip secured in the outlet portion of the third duct in said head and defining together with the surface of said duct said first annular chamber and a longitudinal annular metering passageway communicating therewith; an outer tip disposed coaxially with said inner tip, the interior portion of said outer tip and the exterior of a tubular insert disposed about said inner tip defining a transverse annular metering passageway communicating with said second annular chamber, said outer and inner tips defining a mixing channel there between communicating with said longitudinal annular metering passageway and said transverse annular metering passageway for obtaining a fuel gas mixture and for letting it out; a nut coupling said outer tip and said head together; and said tubular component disposed in said longitudinal annular metering passageway to separate from this passageway said second annular chamber communicating with said transverse annular metering passageway; the internal surface of said outer tip, surrounding the annular mixing channel, being provided with a cylindrical portion and a tapered portion, whose diameter increases toward the outlet of fuel gas mixture, said portions being disposed along the fuel gas mixture stream.

2. An oxygen-fuel cutting torch as claimed in claim 1, having an annular insert adjoining the internal surface of said outer tip, said cylindrical and tapered portions being made on the internal surface of said insert.

* * * * *